United States Patent [19]

Cassina

[11] Patent Number: 4,919,386

[45] Date of Patent: Apr. 24, 1990

[54] FOOT FOR TABLE LEG

[75] Inventor: Franco Cassina, Meda, Italy

[73] Assignee: Cassina S.p.A., Meda, Italy

[21] Appl. No.: 322,558

[22] Filed: Mar. 10, 1989

[30] Foreign Application Priority Data

Sep. 13, 1988 [IT] Italy ..... 21842/88[U]

[51] Int. Cl.[5] ..... F16M 11/24

[52] U.S. Cl. ..... 248/544; 248/188.2

[58] Field of Search ..... 248/544, 677, 188.8, 248/188.9, 346.1, 359 E, 159, 188.2, 649

[56] References Cited

U.S. PATENT DOCUMENTS

| | | | |
|---|---|---|---|
| 1,030,658 | 6/1912 | Gregory | 248/188.2 |
| 2,366,867 | 1/1945 | Nichthauser | 248/188.2 |
| 2,893,164 | 7/1959 | Martin | 248/188.2 |
| 2,933,850 | 4/1960 | Martin | 248/188.2 |
| 4,073,454 | 2/1978 | Sauber | 248/188.2 |

FOREIGN PATENT DOCUMENTS

| | | | |
|---|---|---|---|
| 370809 | 3/1939 | Italy | 248/188.2 |

*Primary Examiner*—Alvin C. Chin-Shue
*Assistant Examiner*—Robert A. Olson
*Attorney, Agent, or Firm*—Herbert Dubno; Andrew Wilford

[57] ABSTRACT

A foot for connection to a leg of a table or the like is basically formed by a stack of similarly upwardly tapered one-piece elements including an upper element, at least one intermediate element, and a lower element all centered on a common upright axis and each having a downwardly flaring skirt having an upper edge and a lower edge and a flat plate bridging the upper edge. These elements all are substantially free of internal structure beneath the respective plates and within the skirt but are of sizes decreasing incrementally from the lower element to the upper element. Each plate is formed at the axis with a central hole and the lower edges of at least the upper and intermediate elements each form a downwardly open seat. The plates of at least the lower and intermediate plates are formed offset from the respective central holes with respective upstanding centering formations complementarily engageable in the seats of the respective immediately overlying elements. The upper element has an upwardly directed centering formation fittable with the lower end of the leg to which the foot is to be attached. A multipart bolt extends axially through the holes and has an upper end engaged with the lower end of the leg fitted to the foot and a lower end bearing upward on the plate of the lower element.

9 Claims, 4 Drawing Sheets

FOOT FOR TABLE LEG

FIELD OF THE INVENTION

The present invention relates to a floor-engaging foot for a piece of furniture. More particularly this invention concerns a table-leg foot.

BACKGROUND OF THE INVENTION

A standard foot for a table leg or other piece of furniture is normally a one-piece item having an upper side provided with a threaded hole or stud by means of which it is attached to the lower end of the leg and a lower side adapted to engage the floor and normally of considerably larger area than the upper side. Thus the foot distributes the weight from the table leg, which is typically of small section, over a substantially greater area.

Stocking by the manufacturer and retailer of such items as well as shipping by these parties is bothersome because they are fairly bulky items. In addition it is necessary to stock a wide range of sizes to accommodate tables of different sizes and weights, as larger and heavier tables require broader-based feet and vice versa.

OBJECTS OF THE INVENTION

It is therefore an object of the present invention to provide an improved foot for a table leg or the like.

Another object is the provision of such an improved foot for a table leg or the like which overcomes the above-given disadvantages, that is which can be rendered compact for ease of storage and shipping, and that can be adapted to pieces of furniture of different sizes.

A further object is to provide such a foot for a piece of furniture that provides a strong and stable base for the leg it is used on.

SUMMARY OF THE INVENTION

A foot for connection to a leg of a table or the like according to this invention is basically formed by a stack of similarly upwardly tapered one-piece elements including an upper element, at least one intermediate element, and a lower element all centered on a common upright axis and each having a downwardly flaring skirt having an upper edge and a lower edge and a flat plate bridging the upper edge. These elements all are substantially free of internal structure beneath the respective plates and within the skirt but are of sizes decreasing incrementally from the lower element to the upper element. Each plate is formed at the axis with a central hole and the lower edges of at least the upper and intermediate elements each form a downwardly open seat. The plates of at least the lower and intermediate plates are formed offset from the respective central holes with respective upstanding centering formations complementarily engageable in the seats of the respective immediately overlying elements. The upper element has an upwardly directed centering formation fittable with the lower end of the leg to which the foot is to be attached. A multipart bolt extends axially through the holes and has an upper end engaged with the lower end of the leg fitted to the foot and a lower end bearing upward on the plate of the lower element.

According to this invention the skirts are all substantially frustoconical. In addition the centering formation of each element is an array of at least three angularly equispaced upstanding lugs and the radial spacing of each array of lugs from the axis increases incrementally downward.

The plate of the lower element is formed centered on the axis with a plurality of apertures complementary to the lugs of the intermediate element. Thus the intermediate element can be fitted underneath inside the lower element with its lugs in the apertures. Furthermore the formation of the upper element is an upwardly extending large-diameter peg having a predetermined axial height, the holes are bigger than the peg, and the plates of the loewr and intermediate elements have a combined thickness greater than the peg height. Thus the elements can be nested together with the intermediate element underneath and inside the lower element and the upper element underneath and inside the intermediate element and with its peg fitting upward through the holes of the intermediate and lower elements.

According to another feature of this invention the bolt is a stack of studs including an upper, an intermediate, and a lower stud each having one end formed with an internally threaded bore and an opposite complementarily externally threaded end. The studs each have an axial length equal generally to the overall height of the lower and intermediate elements. The bolt further includes a washer fitting over the externally threaded end of the lower stud and bearing upward on the plate of the lower element. Resilient rings are engaged between the lower edges of the skirts of the upper and intermediate elements and the outer peripheries of the intermediate and lower elements.

Thus with the system of this invention the assembled foot is extremely strong and stable. The centering formations completely rule out radial shifting of the elements relative to one another and the central bolt locks them axially together and to the leg. At the same time the foot can be knocked down and nested together with the smallest upper element inside the intermediate element which in turn is inside the larger lower element.

DESCRIPTION OF THE DRAWING

The above and other objects, features, and advantages will beocme more readily apparent from the following, reference being made to the accompanying drawing in which.

SPECIFIC DESCRIPTION

Figure 1:
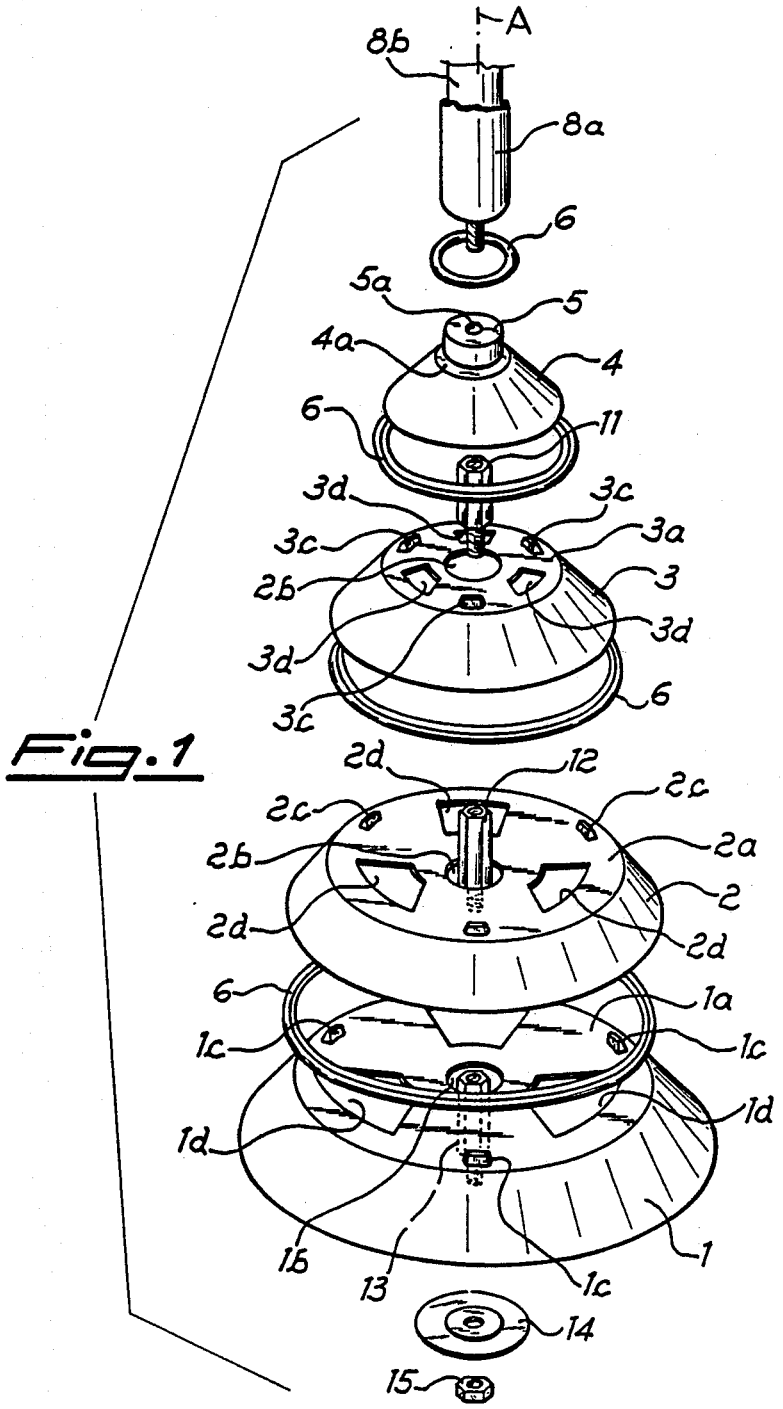
FIG. 1 is a perspective exploded view of the table-leg foot according to this invention.
Figure 2:
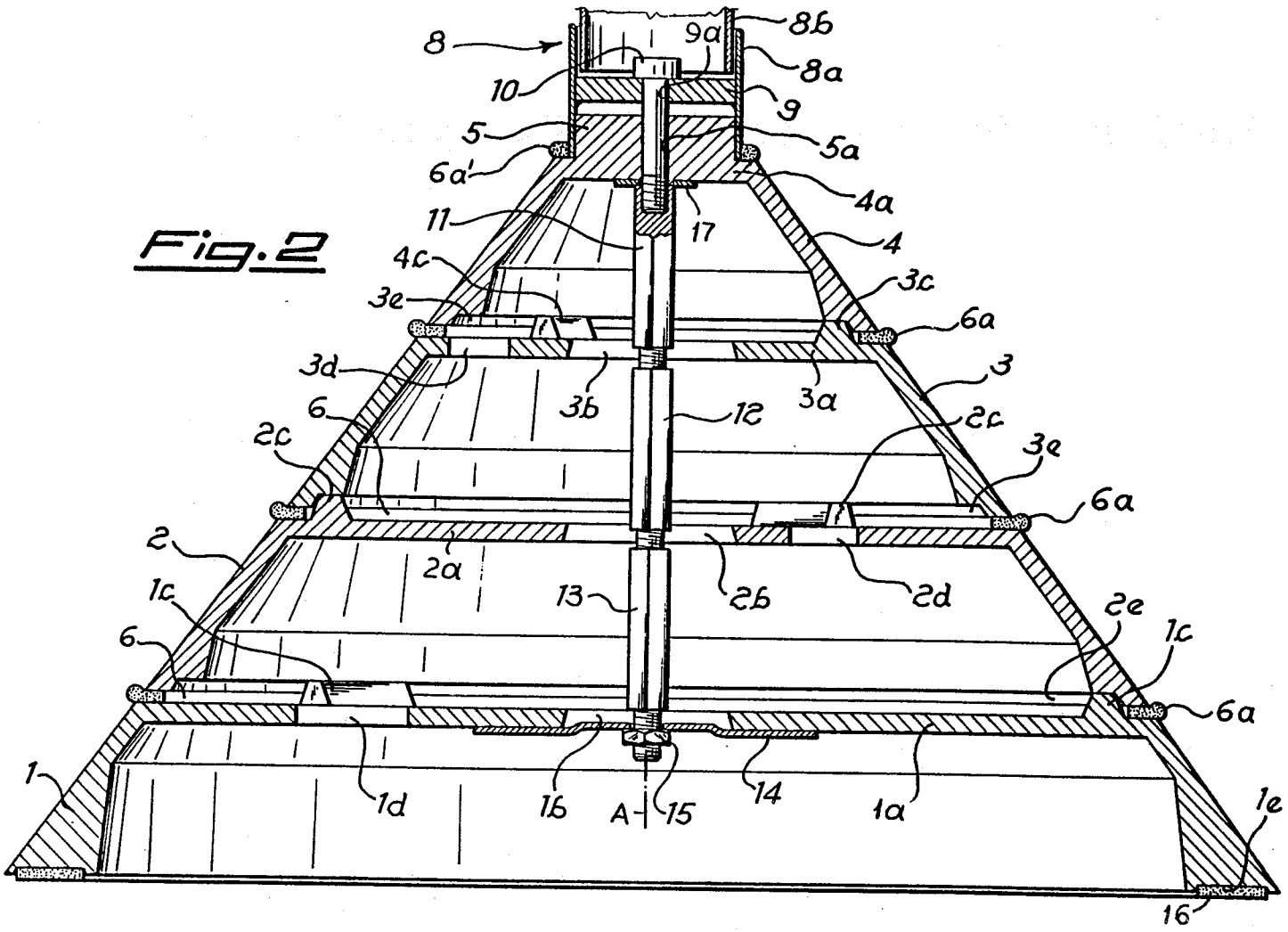
FIG. 2 is a vertical section in large scale of the foot in the set-up use position.
Figure 4:
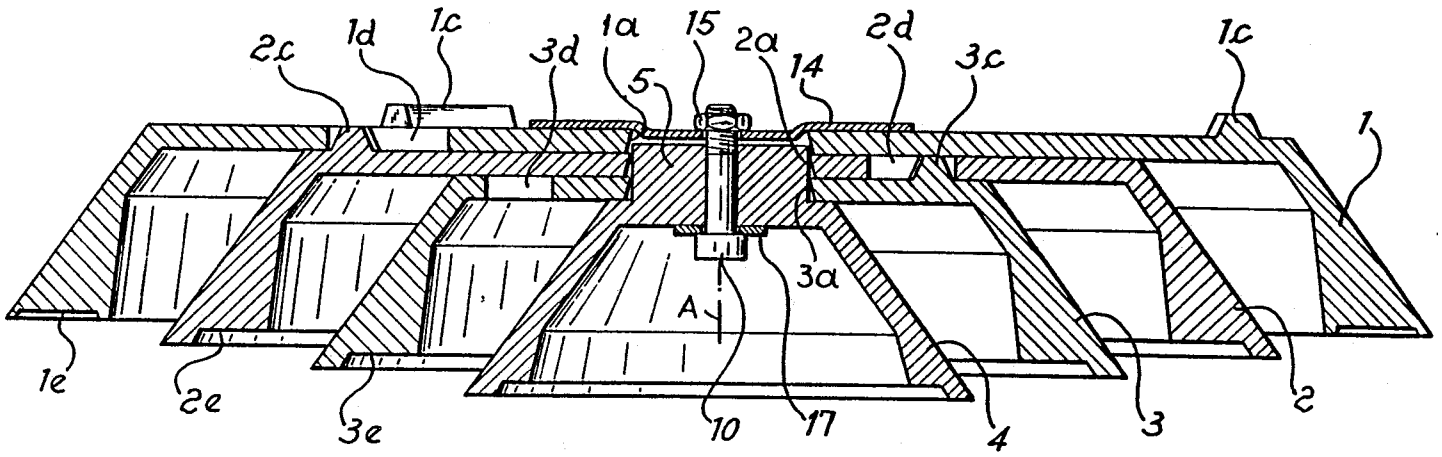
FIG. 4 is a vertical section through the foot of FIG. 2 but in the storage/shipping position.

As seen in FIGS. 1 and 2 a table-leg foot according to this invention comprises four frustoconical elements 1, 2, 3, and 4 of similar shape and same apex angle but incrementally different size. In fact the upper side of each element 1, 2, and 3 is substantially of the same diameter as the lower side of the respective element 2, 3, and 4. When set up to support a table leg 8 as shown in FIGS. 1 and 2 and when knocked down for storage and shipping as shown in FIG. 4 the entire assembly is centered on an axis A.

Each of the lower and intermediate elements 1, 2, and 3 has, in addition to its frustoconical outer skirt, a flat rigid top plate 1*a*, 2*a*, and 3*a* formed centrally with a respective large-diameter circular aperture or hole 1*b*, 2*b*, and 3*b* and extending perpendicular to the axis A. In addition each element 1, 2, and 3 is formed on its upper plate 1*a*, 2*a*, and 3*a* with three angularly equispaced upstanding lugs 1*c*, 2*c*, and 3*c* that are spaced immediately inside their upper outer peripheries at spacings adapted to sit within complimentary circularly annular recesses or seats 2*e*, 3*e*, and 4*e* of the respective overlying intermediate and upper elements 2, 3, and 4. Furthermore each plate 1*a* and 2*a* is formed with a set of three angularly equispaced and axially throughgoing cutouts 1*d* and 2*d* at a radial spacing from the center such that the lugs 2*c* and 3*c* can fit into them, and the plate 3*a* is formed with further such cutouts 3*d* in the event that the stack of elements is higher than four.

The upper element 4 has a top plate 4*a* formed with a central cylindrical upward extension 5 itself formed with a small-diameter axially central passage 5*a*. The table leg 8 has an outer part 8*a* that can fit snugly over the extension 5 and that has a central washer disk 9 with a central hole 9*a* identical to the hole 5*a* and aligned therewith when this part 8*a* fits over the extension 5. The part 8*b* fits within the part 8*a* and is secured thereto by means not shown, for instance the two parts 8*a* and 8*b* can be formed with mating screwthreads for height-adjustment purposes.

In use as shown in FIG. 2 each lower and intermediate element 1, 2, and 3 supports the overlying intermediate and upper element 2, 3, and 4 by means of a resilient washer or ring 6 having an outer edge formed with a circular-section bead 6*a* that is left exposed and that provides a decorative function as well as helping to center itself. Another such ring 6*a*′ sits on a shoulder at the base of the extension 5 outside the lower end of the outer leg part 8*a*.

A bolt 10 extends down through the holes 9*a* and 5*a* and has its head resting on the web 9 and its lower end threaded into the internally threaded upper end of a short stud 11 whose lower end is in turn threaded into the internally threaded upper end of another such stud 12 threaded itself into a further such male/female stud 13. A nut 15 threaded on the lower end of the lower stud 13 bears upward on a washer 14 that bears against the bottom face of the top plate 1*a* and that has a recessed center part that fits within the lower hole 1*b* and that therefore keeps the washer 14 centered. The lowermost element 1 has on the lower edge of its skirt a recess 1*e* in which a floor-protecting resilient ring 16 is received and a washer 17 is provided between the upper end of the stud 11 and the lower face of the plate 4*a*. The studs 11, 12, and 13 all have a height that is slightly greater than the overall axial dimension or height of the lower and intermediate elements 1, 2, and 3, which as described above are all the same.

Thus when the foot is set up as shown in FIG. 2 it is a tall and stable construction with a relatively large base. The interfit of the lugs 1*c*, 2*c*, and 3*c* in the eats 2*e*, 3*e*, and 4*e* makes relative radial shifting of the elements 1 through 4 impossible, and the bolt assembly 10–15 firmly locks them together and to the table leg 8 in the axial direction. Nonetheless the structure can be taken apart simply by removing the nut 15 and then taking off the elements 1 through 3 and finally the studs 11 through 13 in an order opposite that used to assemble the foot.

Figure 3:
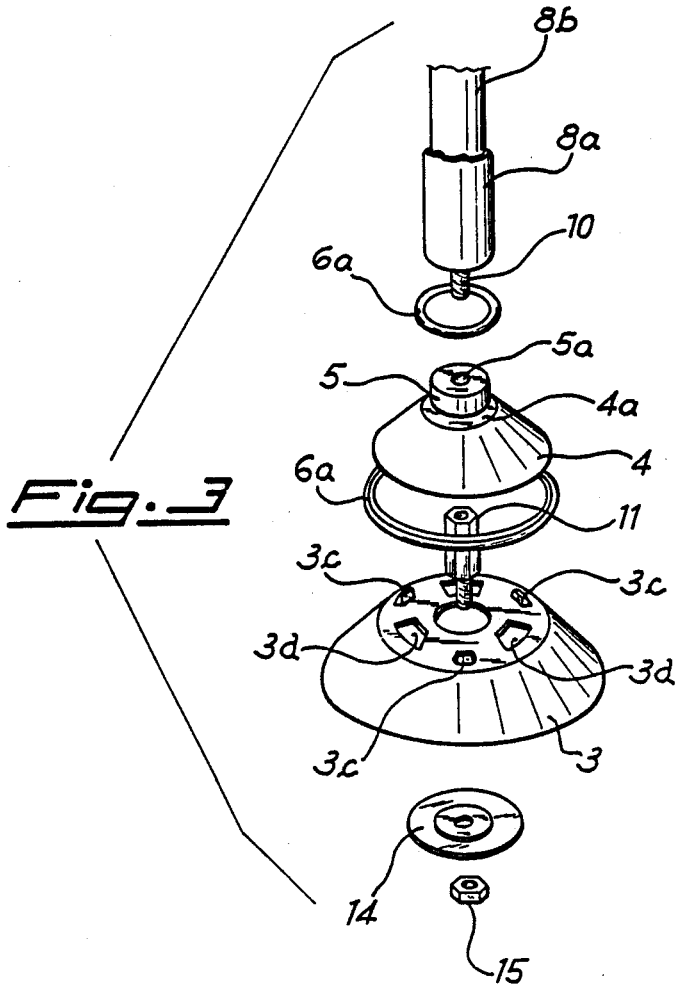
FIG. 3 is a vertical section of another arrangement according to this invention.

Furthermore if a shorter and less wide foot is needed it is possible as shown in FIG. 3 to dispense with the elements 1 and 2 and with the studs 12 and 13. It would similarly be possible to provide further such elements for an even higher and broader-based construction.

Finally as shown in FIG. 4 it is possible for shipping to nest the elements 1 through 4 together in reverse order, that is with the smallest element 4 lowermost, topped by the elements 3, 2, and 1, in that order. The studs 3*c* and 2*c* therefore fit into the apertures 2*d* and 1*d* and the extension 5 fits up into the aligned holes 1*a*, 2*a*, and 3*a*, it being noted that it is shorter above the plate 4*a* than the combined thicknesses of the plates 1*a*, 2*a*, and 3*a*. The bolt 10 is fitted upward through the element 4 and washer 17 from below and the washer 14 and 15 are set onto the top of the plate 1*a* to lock the entire structure together axially. The rings 6 and studs 11, 12, and 13 can easily be packed in this knocked-down assembly which takes up only slightly more space than the element 1 all by itself.

For use the assembly as shown in FIG. 4 can easily be taken apart and reassembled in reverse order to make up the foot as shown in FIG. 2. The ability to make the foot so compact is extremely convenient both with regard to stocking space and shipping costs for the manufacturer and retailer.

I claim:

1. In combination with a leg of a table or the like, a foot comprising:

a stack of similarly upwardly tapered one-piece elements including an upper element, an intermediate element, and a lower element all centered on a common upright axis, the elements each having a downwardly flaring skirt having an upper edge and a lower edge and a flat plate bridging the upper edge, the elements all being substantially free of internal structure beneath the plate and within the skirt but being of sizes decreasing incrementally from the lower element to the upper element, each plate being formed at the axis with a central hole, the lower edges of at least the upper and intermediate elements each forming a downwardly open seat, the plates of at least the lower and intermediate plates being formed offset from the respective central holes with respective upstanding centering formations complementarily engageable in the seats of the respective immediately overlying elements, the upper element having an upwardly directed centering formation fittable with the lower end of the leg to which the foot is to be attached; and a multipart bolt extending axially through the holes and having an upper end engaged with the lower end of the leg fitted to the foot and a lower end bearing upward on the plate of the lower element.

2. The foot defined in claim 1 wherein the skirts are all substantially frustoconical.

3. The foot defined in claim 1 wherein the formation of the upper element is an upwardly extending large-diameter peg having a predetermined axial height, the holes of the lower and intermediate elements being bigger than the peg, the plates of the lower and intermediate elements having a combined thickness greater than the peg height, whereby the elements can be nested together with the intermediate element underneath and inside the lower element and the upper element underneath and inside the intermediate element and with its peg fitting upward through the holes of the intermediate and lower elements.

4. The foot defined in claim 1, further comprising resilient rings engaged between the lower edges of the skirts of the upper and intermediate elements and the outer peripheries of the intermediate and lower elements.

5. The foot defined in claim 1 wherein there are a plurality of such intermediate elements.

6. The foot defined in claim 1 wherein the centering formation of each element is an array of at least three angularly equispaced upstanding lugs, the radial spacing of each array of lugs from the axis increasing incrementally downward.

7. The foot defined in claim 6 wherein the plate of the lower element is formed centered on the axis with a plurality of apertures complementary to the lugs of the intermediate element, whereby the intermediate element can be fit underneath inside the lower element with its lugs in the apertures.

8. The foot defined in claim 1 wherein the bolt is a stack of studs including an upper, an intermediate, and a lower stud each having one end formed with an internally threaded bore and an opposite complementarily externally threaded end, the studs having an axial length equal generally to the overall height of the lower and intermediate elements.

9. The foot defined in claim 8 wherein the bolt-further includes a washer fitting over the externally threaded end of the lower stud and bearing upward on the plate of the lower element.

* * * * *